US007938528B2

(12) United States Patent
Thayer et al.

(10) Patent No.: US 7,938,528 B2
(45) Date of Patent: May 10, 2011

(54) SYSTEM AND METHOD OF ADJUSTING BLADE LOADS FOR BLADES ENGAGING IMAGE FORMING MACHINE MOVING SURFACES

(75) Inventors: Bruce E. Thayer, Webster, NY (US); Richard W. Seyfried, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 40 days.

(21) Appl. No.: 12/201,140

(22) Filed: Aug. 29, 2008

(65) Prior Publication Data

US 2010/0053293 A1 Mar. 4, 2010

(51) Int. Cl.

| | |
|---|---|
| ***B41J 2/01*** | (2006.01) |
| ***G03G 15/20*** | (2006.01) |
| ***G03G 21/00*** | (2006.01) |
| ***G03G 15/00*** | (2006.01) |

(52) U.S. Cl. ..... 347/103; 399/308; 399/350; 399/71

(58) Field of Classification Search ..... None
See application file for complete search history.

(56) References Cited

U.S. PATENT DOCUMENTS

| | | | | |
|---|---|---|---|---|
| 4,579,081 | A * | 4/1986 | Kohyama | 399/119 |
| 5,208,639 | A | 5/1993 | Thayer et al. | |
| 5,264,904 | A | 11/1993 | Audi et al. | |
| 5,546,165 | A | 8/1996 | Rushing et al. | |
| 5,610,699 | A | 3/1997 | Yu et al. | |
| 5,778,296 | A | 7/1998 | van der Steen et al. | |
| 6,438,329 | B1 | 8/2002 | Budnik et al. | |
| 2003/0232262 | A1 | 12/2003 | Yamada et al. | |
| 2006/0001911 | A1 | 1/2006 | Viassolo et al. | |
| 2006/0115285 | A1 | 6/2006 | Thayer | |
| 2007/0020005 | A1 | 1/2007 | Shigezaki et al. | |
| 2007/0047976 | A1 * | 3/2007 | Hamby et al. | 399/12 |
| 2007/0139496 | A1 | 6/2007 | Leighton et al. | |
| 2007/0182800 | A1 | 8/2007 | Fioravanti et al. | |

FOREIGN PATENT DOCUMENTS

JP 06180542 A * 6/1994

OTHER PUBLICATIONS

Partial English translation of JP 06-180542, Jun. 28, 1994, [online], [retrieved on Jul. 1, 2010] Retrieved from the Industrial Property Digital Library of the Japanese Patent Office using Internet <URL: http://www.ipdl.inpit.go.jp/homepg_e.ipdl>.*

* cited by examiner

*Primary Examiner* — Omar Rojas
(74) *Attorney, Agent, or Firm* — Fay Sharpe LLP

(57) ABSTRACT

Systems and methods of providing controlled blade engagement with an image forming machine moving surface are provided for metering a release agent onto the surface, cleaning the surface, or both. A blade engagement apparatus is provided having a controller controlling an actuator connected to a blade positioning mechanism for providing controlled engagement of the blade with the moving surface. The minimum blade load applied by the blade to the moving surface needed to prevent defects is determined and maintained for increasing the useful life of the blade. Control systems and methods utilizing single and separately operable dual blade positioning mechanisms are provided.

20 Claims, 7 Drawing Sheets

SYSTEM AND METHOD OF ADJUSTING BLADE LOADS FOR BLADES ENGAGING IMAGE FORMING MACHINE MOVING SURFACES

CROSS REFERENCE TO RELATED APPLICATIONS

Attention is directed to co-pending applications U.S. application Ser. No. 11/877,770 filed Oct. 24, 2007, entitled "LONG LIFE CLEANING SYSTEM WITH REPLACEMENT BLADES": U.S. application Ser. No. 12/201,230 filed concurrently herewith, entitled "RELEASE AGENT APPLICATION APPARATUS FOR IMAGE FORMING MACHINES"; the disclosure found in these co-pending applications is hereby incorporated herein by reference in its entirety. The appropriate components and processes of the above co-pending applications may be selected for the teaching and support of the present application in embodiments thereof.

BACKGROUND

Disclosed in embodiments herein are systems and methods for engaging cleaning and/or metering blades with image forming machine moving surfaces and more specifically to systems and method of determining and maintaining minimum blade loads needed for preventing image defects.

In electrophotographic image forming applications such as xerography, a charge retentive moving photoreceptor belt, plate, or drum is electrostatically charged according to the image to be produced. In a digital printing image forming machine, an input device such as a raster output scanner controlled by an electronic subsystem can be adapted to receive signals from a computer and to transpose these signals into suitable signals so as to record an electrostatic latent image corresponding to the document to be reproduced on the photoreceptor. In a digital copier, an input device such as a raster input scanner controlled by an electronic subsystem can be adapted to provide an electrostatic latent image to the photoreceptor. In a light lens copier, the photoreceptor may be exposed to a pattern of light or obtained from the original image to be reproduced. In each case, the resulting pattern of charged and discharged areas on moving photoreceptor surface form an electrostatic charge pattern (an electrostatic latent image) conforming to the original image.

The electrostatic image on the moving photoreceptor may be developed by contacting it with a finely divided electrostatically attractable toner. The toner is held in position on the photoreceptor image areas by the electrostatic charge on the surface. Thus, a toner image is produced in conformity with a light image of the original. Once each toner image is transferred to a substrate, and the image is affixed thereto forming a permanent record of the image to be reproduced. In the case of multicolor copiers and printers, the complexity of the image transfer process is compounded, as four or more colors of toner may be transferred to each substrate sheet. Once the single or multicolored toner is applied to the substrate, it is permanently affixed to the substrate sheet by fusing, so as to create the single or multicolor copy or image print.

Following the photoreceptor to substrate toner transfer process, it is necessary to at least periodically clean the charge retentive surface of the moving photoreceptor surface. In order to obtain the highest quality copy or print image, it is generally desirable to clean the photoreceptor each time toner is transferred to the substrate. In addition to removing excess or residual toner, other particles such as paper fibers, toner additives and other impurities (hereinafter collectively referred to as "residue") that may remain on the charged moving surface of the photoreceptor.

Further, in solid ink imaging systems having intermediate members, ink is loaded into the system in a solid form, either as pellets or as ink sticks, and transported through a feed chute by a feed mechanism for delivery to a heater assembly. A heater plate in the heater assembly melts the solid ink impinging on the plate into a liquid that is delivered to a print head for jetting onto an intermediate member. In the print head, the liquid ink is typically maintained at a temperature that enables the ink to be ejected by the printing elements in the print head, but that preserves sufficient tackiness for the ink to adhere to the intermediate member. In some cases, however, the tackiness of the liquid ink may cause a portion of the ink to remain on the intermediate member after the image is transferred onto the media sheet. This remnant of the jetted image may later degrade other images formed on the intermediate member.

Solid ink jet imaging systems generally use an electronic form of an image to distribute ink melted from a solid ink stick or pellet in a manner that reproduces the electronic image. In some solid ink jet imaging systems, the electronic image may be used to control the ejection of ink directly onto a media sheet. In other solid ink jet imaging systems, the electronic image is used to eject ink onto an intermediate imaging member. A media sheet is then brought into contact with the intermediate imaging member in a nip formed between the intermediate member and a transfer roller. The heat and pressure in the nip helps transfer the ink image from the intermediate imaging member to the media sheet.

One issue arising from the transfer of an ink image from an intermediate imaging member to a media sheet is the transfer of some ink to other machine components. For example, ink may be transferred from the intermediate imaging member to a transfer roller when a media sheet is not correctly registered with the image being transferred to the media sheet. The pressure and heat in the nip may cause a portion of the ink to adhere to the transfer roller, at least temporarily. The ink on the transfer roller may eventually adhere to the back side of a subsequent media sheet. If duplex printing operations are being performed, the quality of the image on the back side is degraded by the ink that is an artifact from a previous processed image.

To address these problems, various release agent applicators have been designed, often as part of an image drum maintenance system. These release agent applicators provide a coating of a release agent, such as silicone oil, onto the intermediate imaging member to reduce the undesired build-up of ink. The amount of release agent applied by such applicators is carefully controlled to achieve a desired amount. Using of too much release agent causes undesirable streak defects, also known as oil streaks, on the output prints.

Release agent applicators typically use a sump system in which a roller is partially immersed in an oil sump. As the release agent roller of an image drum maintenance system rotates out of the sump, it applies release agent to the intermediate imaging member in a desired amount. Prior to the intermediate imaging member reaching the transfer roller nip, the release agent is metered with a blade to achieve the desired thin layer of oil on the intermediate member which does not degrade the media sheet in the nip or cause oil streaks. The excess oil metered from the intermediate member by the blade is directed back into the sump. A blade positioning mechanism is used to bring the blade into contact with the imaging member creating a blade interference with the imaging member that provides a suitable pressure against the blade, referred to as the blade load, sufficient to meter the desired amount of release agent onto the imaging member.

The imaging member is typically a rotating drum formed of a hard material, such as for example aluminum, or other suitable materials. The surface is often etched to provide a suitable texture for good release agent dispersion. The surface is often anodized to provide sufficient hardness for wear. Rather high blade loads are needed to obtain the thin thickness layer of release agent on the drum surface to achieve the desired results. The rough, hard imaging member surfaces and the high blade loads result in the blade having an operational life which is typically shorter than desired. Further, blades perform best, and last the longest, when they are uniformly loaded to the appropriate blade load by the blade positioning mechanism. Part tolerances for the blade positioning mechanism typically require that a blade be loaded higher than may be desired for optimum functioning in order to guarantee achieving an appropriate blade load over the expected life of the blade. These higher blade loads increases blade wear and shorten blade life. The control of the amount of blade load and its uniformity through tighter tolerances in the blade positioning mechanism part adds complexity and cost. Blade material properties can also change over time due to blade relaxation, wear, environmental conditions, and other causes which change the blade loads being applied by the blade positioning mechanism.

The present application provides a new and improved apparatus for cleaning and/or metering a release agent onto an image forming device moving surface which overcomes these above-described problems.

DETAILED DESCRIPTION

Figure 1:
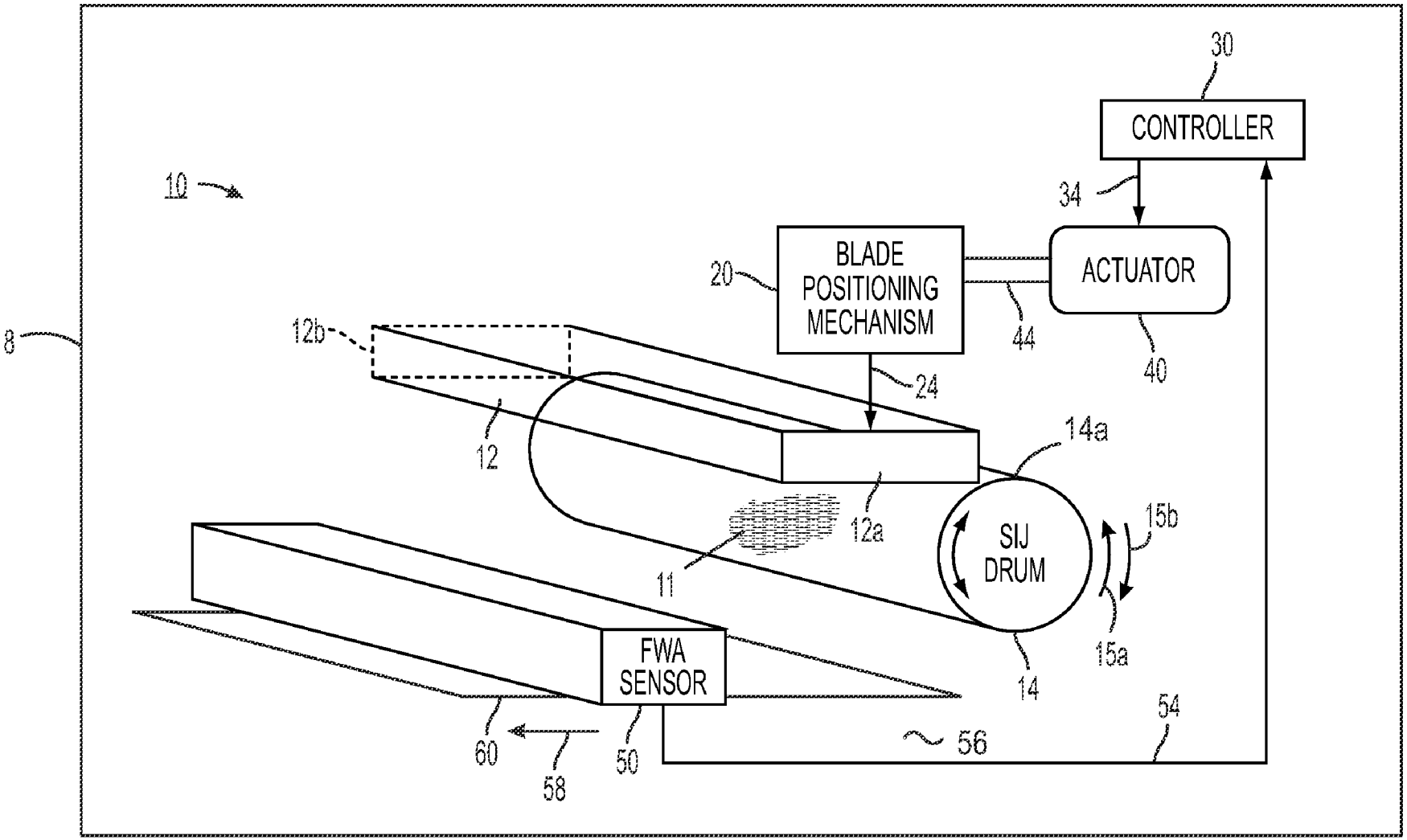
FIG. 1 is a diagram illustrating a blade engagement apparatus for determining and maintaining the minimum blade load on image forming machine moving surfaces for preventing streak defects in images.
Figure 2:
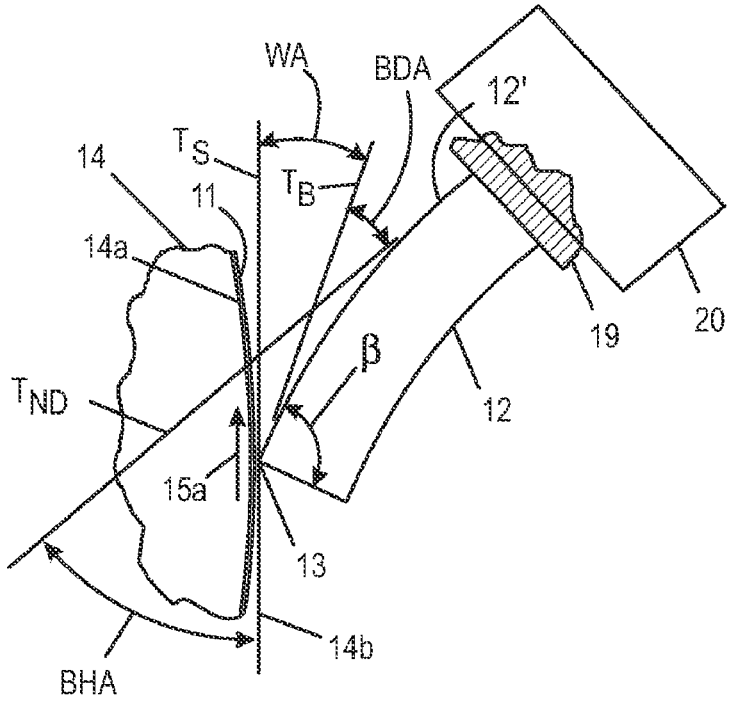
FIG. 2 illustrates a blade disposed in a working position engaging flat and cylindrical moving surfaces in a doctor blade orientation.
Figure 3:
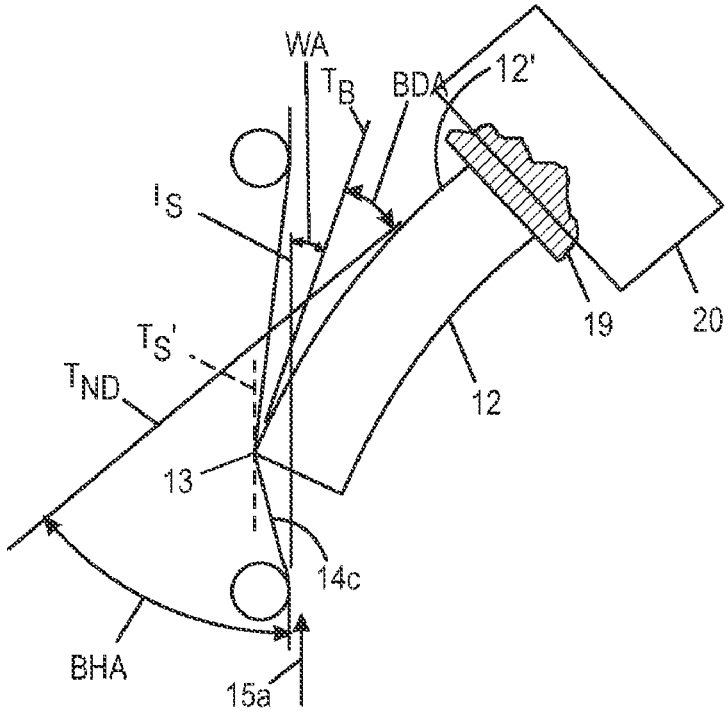
FIG. 3 illustrates a blade disposed in a working position engaging a moving belt in a doctor blade orientation.
Figure 4:
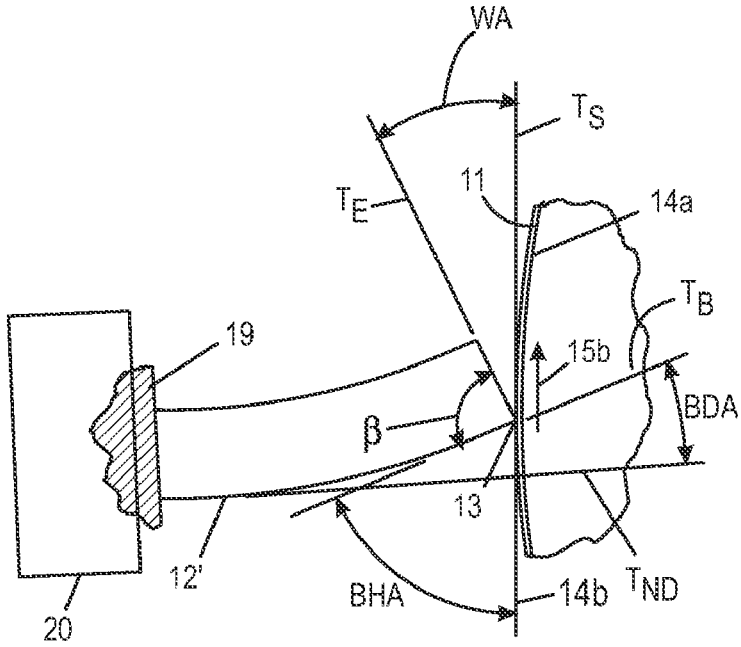
FIG. 4 illustrates a blade disposed in a working position engaging flat and cylindrical moving surfaces in a wiper blade orientation.
Figure 5:
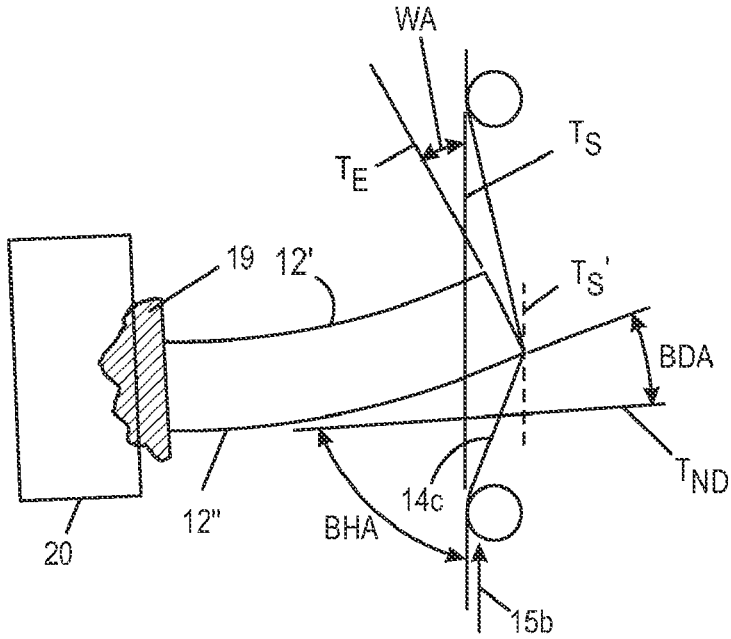
FIG. 5 illustrates a blade disposed in a working position engaging a moving belt in a wiper blade orientation.

Referring now to FIG. 1, an image forming machine, shown generally at 8, includes a moving surface 14 moving in an operational direction 15*a* or 15*b*. The moving surface 14 can be suitable for receiving a controlled application of a release agent, or a surface suitable for cleaning, such as the removal of toner waste material etc., or both. It can have different shapes as depicted in FIGS. 1-5. For example, the moving surface 14 can be a cylindrical surface 14*a* rotating in a rotational direction of operation 15*a* or 15*b*, such as a solid ink jet (SIJ) drum used in SIJ machines 8 as shown in FIGS. 1, 2 and 4. In other examples, the cylindrical surface 14*a* can be an imaging member, such as a photoreceptor, or a glossing drum, or a transfer surface, or other like surfaces. The image forming machine moving surface 14 can also be flat 14*b*, such as a flat rigid photoreceptor or transfer surface, moving in an operational direction 15*a* or 15*b* as shown in FIGS. 2 and 4. The image forming machine moving surface 14 can also be a belt 14*c*, such as a photoreceptor belt, or the like, moving in an operational direction 15*a* or 15*b* as shown in FIGS. 3 and 5. The moving surfaces 14*a*, 14*b*, and/or 14*c* shall be referred to generally as surface 14.

Referring again to FIG. 1, the image forming machine 8 also includes a blade engagement apparatus, shown generally at 10, having one or more blades 12. For the purposes of clarity, a single blade 12 is shown, however, it should be appreciated that the blade engagement apparatus 10 can include a plurality of blades. The blade 12 is elongated, having a width extending transversely across surface 14 (with respect to the operational direction 15*a*, 15*b*) from an inboard end 12*a* to an outboard end 12*b*.

The blade includes a blade tip 13, shown in FIGS. 2-5, which is brought into controlled engagement with the moving surface 14 as the blade reaches a working position, also referred to as an operational position, as described in further detail below. The blade tip 13 extends axially along the width of the blade 12 a distance sufficient to extend transversely across the portion of the surface 14 to be engaged.

The blade engagement apparatus 10 can be a release agent application apparatus for applying a controlled amount (thickness) of release agent, a portion of which is shown at 11, to the surface 14, in a process referred to herein as metering. During metering, the release agent 11 is initially applied to the surface 14 using a roller, or in other known manners, and then metered to a desired thickness by the blade 12 engaging the surface while disposed in the working position. The blade engagement apparatus 10 can be a cleaning apparatus for cleaning debris from the moving surface 14 with the blade as it is disposed in the working position. The blade engagement apparatus 10 can be configured for cleaning, or metering, or both simultaneously.

The blade engagement apparatus 10 also includes a blade positioning mechanism 20 connected to the blade 12, as shown at 24, for moving the blade into the working position thereby creating a blade load at the blade tip 13 against the surface or material on the surface such as a release agent, as described in further detail below. While the blade 12 is in the working position, the blade positioning mechanism 20 can vary the blade load, increasing it by moving the blade in a direction towards the surface 14, and decreasing it by moving the blade in a direction away from the surface.

It is contemplated that a variety of different blade positioning mechanisms may be used. Examples can include those provided in the co-pending applications U.S. application Ser. No. 11/877,770 filed Oct. 24, 2007, entitled "LONG LIFE CLEANING SYSTEM WITH REPLACEMENT BLADES"; and U.S. application Ser. No. 12/201,230 filed concurrently herewith, entitled "RELEASE AGENT APPLICATION APPARATUS FOR IMAGE FORMING MACHINES" the disclosure of which was previously incorporated by reference herein. Further examples can include those provided in the co-pending applications U.S. application Ser. No. 12/021,500 filed Jan. 29, 2008, entitled "DUAL BLADE CLEANING SYSTEM"; U.S. application Ser. No.

12/201,039 filed concurrently herewith, entitled "DUAL BLADE RELEASE AGENT APPLICATION APPARATUS"; U.S. application Ser. No. 12/201,738 filed concurrently herewith, entitled "BLADE ENGAGEMENT APPARATUS FOR IMAGE FORMING MACHINES" the disclosure of which is hereby incorporated by reference herein in its entirety.

The blade engagement apparatus 10 also includes an actuator 40 connected to the blade positioning mechanism 20, as shown at 44, for providing actuating movement to the blade positioning mechanism 20. The actuator 40 can be a stepper motor for applying rotational movement to the blade positioning mechanism 20. It can also be a linear actuator for applying linear movement to the blade positioning mechanism 20. The blade positioning mechanism 20 transfers the actuating movement into the blade movement described above.

The actuator 40 can be considered bi-directional, providing actuation of a first direction to the blade positioning mechanism 20 moving the blade 12 in a direction towards the surface 14 for moving the blade into the working position and for increasing the blade load on surface 14 while the blade is in the working position. The actuator 40 can provide actuation of a second direction to the blade positioning mechanism 20 moving the blade 12 in a direction away from the surface 14 for decreasing the blade load on surface 14 while the blade is in the working position, or for moving the blade out of the working position disengaging it from the surface. The actuator 40 can provide the actuating movement to the blade positioning mechanism 20 in small increments across a range of actuation. The actuator 40 can include limits of actuation at both ends of its actuation range.

A controller 30 is used to provide control signals 34 to the actuator 40 for actuating the blade positioning mechanism 20 in the first and second directions. The controller 30 can increment the actuator 40 in either direction in one or more increments as needed. The position, or location, of the actuator 40 within its range of actuation, referred to herein as the actuation position, can be communicated to the controller 30 in a known manner. The actuation position can be used by the controller 30 as a representation of the magnitude of the blade load or the blade interference in the working position, as shall be described in further detail below.

A sensor 50 is connected to the controller 30 as shown at 54. The sensor 50 can be disposed adjacent to the path of the output prints, one of which is shown at 60, formed by the image forming machine 8. The sensor 50 can be a Full Width Array (FWA) sensor extending transversely across the print 60 for sensing the entire area of the print as the print moves past the sensor as shown at 58. The sensor 50, such as a FWA sensor, can also extend transversely across the moving surface 14 for the entire width of the blade 12.

The FWA sensor 50 uses an array of optical sensors arranged linearly along its length to sense for variations in light reflected off the print 60, or moving surface 14, caused by undesirable defects. These defects can include streaks created when an insufficient amount of release agent has been metered onto surface 14 during metering. The defects can also be created when undesirable material, such as for example toner waste particles or the like, has not been sufficiently cleaned from the surface 14 during a cleaning operation. The defects can also include the remainder of cleaning evaluation stripes (17 in FIG. 7) applied transversely across the surface 14 which have not been removed by the blade 12 due to insufficient blade loads in a cleaning operation as described in further detail below.

Upon sensing one or more defects, the sensor 50 produces a defect signal, shown generally at 56, which is sent to the controller 30. The controller 30, upon receiving the defect signal 56, determines that one or more defects are being detected on print 60 or surface 14. The linear arrangement of the plurality of sensors used in the FWA sensor 50 can provide location information with the defect signal 56 for determining the location of the one or more defects. As an example, the sensor or sensors detecting the defect can be identified and this information, coupled with their known location along the array 50, can be used by the controller 30 for determining the location, or locations, of the defects on the print 60 or surface 14. The locations of the defects on the print 60, or the surface 14, can then be translated into respective locations along the blade width.

Referring now to FIG. 2, a blade 12 disposed in the working position is shown in greater detail. The blade 12 is preferably formed of a resilient, or compliant, elastomeric material, such as for example polyurethane. The blade 12 extends from a blade holder 19 a distance which can be referred to as the blade length. While the blade 12 is engaged with surface 14, application forces applied to the blade by the blade positioning mechanism 20 bend the blade deflecting it by a Blade Deflection Angle (BDA), which can be measured between $T_B$ and $T_{ND}$. The blade 12 can thus be considered to be in deflected engagement with surface 14 while in any of the working positions described herein. The blade holder 19, formed of metal such steel or aluminum, or other rigid material, can be connected to, or integrated with, the blade 12 to evenly distribute the application forces along the blade width.

In the example working position illustrated in FIG. 2, the blade 12 is in a doctor blade orientation, hereinafter referred to as $WP_{DB}$, with respect to a cylindrical moving surface 14*a* and a flat rigid moving surface 14*b*. For the purposes of this description, a tangent $T_S$ is taken at the tip location at curved moving surface 14*a* which can be considered as being similar to the flat moving surface 14*b*.

The blade positioning mechanism 20 orients the blade 12 so that the Blade Holder Angle (BHA) <90 degrees as defined from the downstream side of the blade 12' from the blade tip 13, defined in relation to the operational direction of movement 15*a* of surface 14*a* or 14*b*. BHA can be measured as the angle between $T_{ND}$ and $T_S$, where $T_{ND}$ is a tangent extending along the undeflected downstream side 12' of the blade 12, for example just as the blade extends from the rigid blade holder 19, and $T_S$ is a tangent to the tip location at the surface 14*a*, 14*b*.

In $WP_{DB}$, the blade member 12 forms a working angle WA measured at the downstream side of the tip 13 between $T_B$ and $T_S$ (a tangent to surface 14*a*). The BDA range is chosen to provide a desired blade load for the chosen blade material. The modulus of the blade material, the blade thickness, the length of the blade extension from the blade holder 19 and the friction against the moving surface 14*a* determine the blade deflection, as measured by the BDA, required to obtain the desired blade load. The BHA is chosen to obtain both the desired BDA and WA.

Referring now to FIG. 3 the doctor blade orientation for blade 12 disposed in $WP_{DB}$ for a flexible moving surface 14*c* is shown. BDA is measured in a similar manner as described above, as the angle between $T_B$ and $T_{ND}$. BHA is measured as the angle between $T_{ND}$ and $T_B$. WA is the angle between $T_B$ and $T_S$.

The blade 12 can also be in a wiper blade orientation with respect to surface 14 while in the working position, referred to as $WP_{WB}$. Referring now to FIG. 4, the blade 12 is shown in $WP_{WB}$ with respect to a cylindrical moving surface 14*a*, and for a flat rigid moving surface 14*b*. In $WP_{WB}$, the blade positioning mechanism 20 orients the blade 12 so that BHA<90 degrees as defined from the upstream side of the blade 12" of the blade tip 13. BHA can be measured as the angle between $T_{ND}$ and $T_S$ as shown. Tangents $T_S$, $T_B$, and $T_{ND}$ similar to those described above are used.

In $WP_{WB}$, the blade 12 has also been moved into deflected engagement with the surface 14*a* using a predetermined pressure applied by the blade positioning mechanism 20 for metering, cleaning or both. The compliant blade 12 is deflected by the predetermined Blade Deflection Angle (BDA), which can be measured between $T_B$ and $T_{ND}$. In $WP_{WB}$, the blade 12 forms a working angle WA measured at the downstream side of the blade tip 13 between a tangent to the end of the blade member $T_E$ and $T_S$ as shown. In the example provided, similar ranges to those described above are contemplated.

Referring now to FIG. 5 the wiper blade orientation for the blades 12 disposed in $WP_{WB}$ for a flexible photoreceptor 14*c* having a flexible moving surface is shown. BDA is measured in a similar manner as described above, as the angle between $T_B$ and $T_{ND}$. BHA is measured as the angle between $T_{ND}$ and $T_S$. WA is the angle between $T_E$ and $T_S$.

The interaction of the compliant blade 12 in deflected engagement with the moving surface 14 in the working positions ($WP_{DB}$, $WP_{WB}$), as described with reference to FIGS. 2-5 above, can be referred to generally as the blade interference. The blade interference can be considered a measure of how far the blade tip would extend into the surface 14 if the blade 12 did not deflect as described above. Moving the blade 12 in a direction towards the surface 14, with the blade at the working position, increases the interference and the blade deflection, thereby increasing the blade load at the blade tip 13 against the surface 14 or material thereon. Whereas, moving the blade 12 in a direction away from the surface 14, with the blade disposed in the working position, decreases the interference and the blade deflection, thereby decreasing the blade load at the blade tip 13.

The blade load can be adjusted for metering the desired amount of release agent 11 onto surface 14 during metering, or for sufficiently removing material from surface 14 during cleaning, or both. Increasing the blade load meters a thinner layer of release agent 11 onto the surface 14 during metering, whereas decreasing the blade load meters a thicker layer of release agent onto the surface. For a cleaning operation, increasing the blade load cleans more material from surface 14, whereas decreasing the blade load cleans less material from the surface.

Figure 6:
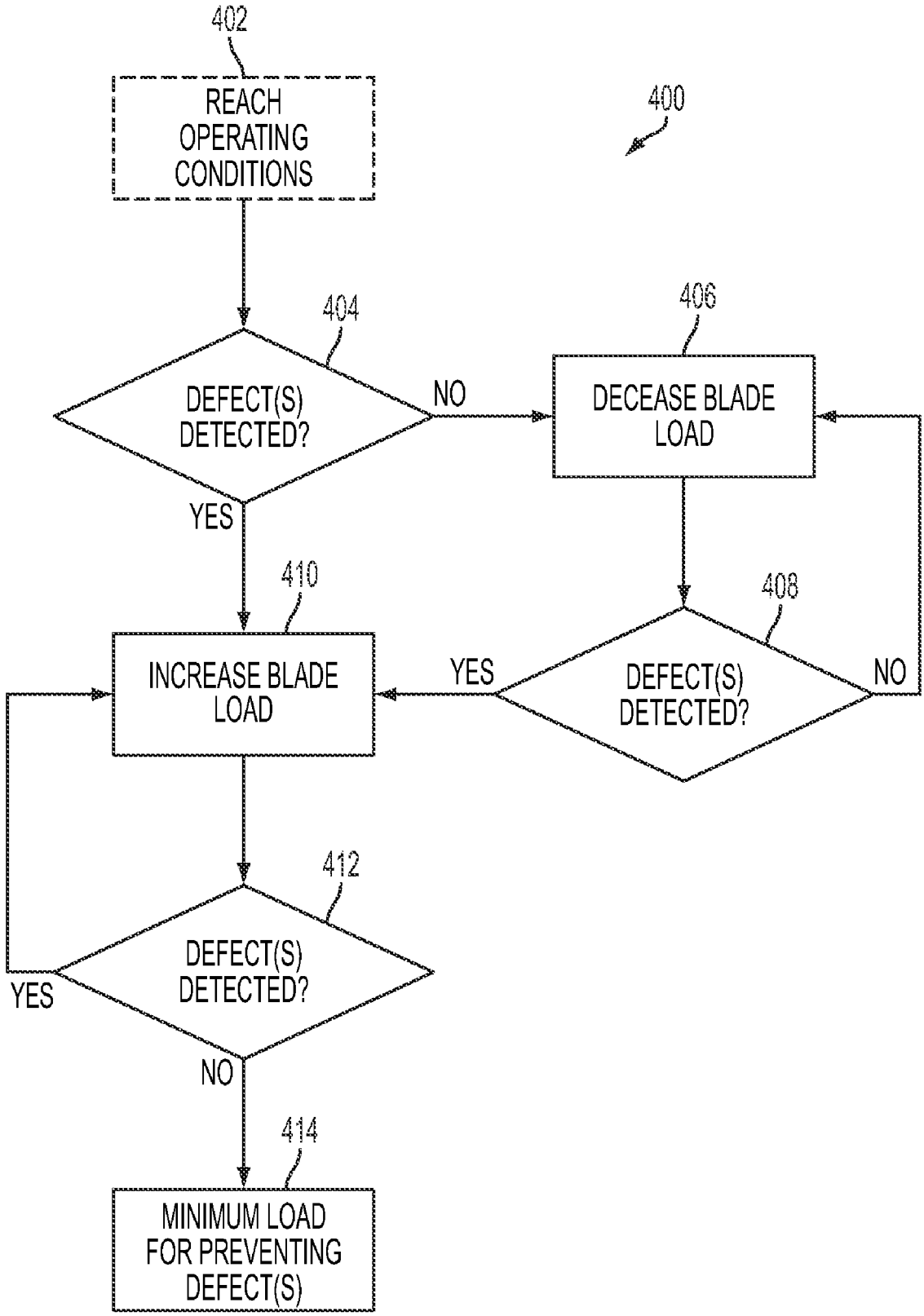
FIG. 6 illustrates method of determining and maintaining the minimum blade load on image forming machine moving surfaces for preventing streak defects in images.

Referring now to FIG. 6, a method of determining and maintaining the minimum blade load for a blade 12, disposed in a working position $WP_{DB}$ or $WP_{WB}$ at the surface 14 during a metering and/or cleaning operation while preventing defects, as defined above, is shown generally at 400. The image forming machine can optionally be allowed to reach normal operating conditions at 402, if so desired. At 404, the controller 30 determines if one or more defects are being detected on an output print 60 or on surface 14 using defect signal 56. If defect(s) are detected by the controller at 404, the controller 30 increases the blade load at 410 by signaling actuator 40 to actuate the blade positioning mechanism 20 to move the b lade in a direction towards surface 14, as described above.

If no defect is being detected at 404, the blade load at surface 14 may be higher than optimum which can lead to premature blade failure. Controller 30 decreases the blade load as described above at 406 by signaling actuator 40 to actuate the blade positioning mechanism 20 to move the blade in a direction away from surface as described above.

The controller then determines, at 408, if defects are being detected on the output print 60 or surface 14. If no defects are detected, the controller 30 continues to decrease the blade load at the surface 14 in increments at 406, until one or more defects are detected at 408.

When the blade load at the surface 14 is sufficiently low to produce one or more defects, as detected by sensor 50 at 404, the controller 30 proceeds with determining the minimum blade load for preventing defects on the output prints 60 or on surface 14. The controller 30 increases the blade load at 410, and determines if defects are being detected at 412. If a defect is detected at 412, the controller increases the blade interference at 410 again and then determines if defects are still detected at 412. This cycle is repeated until no defects are detected at 412 thereby achieving the minimum blade load for preventing defects at 414.

Misalignment of the blade axis with respect to the SIJ drum surface can result in a variation in blade load across the process direction (moving from the inboard to the outboard sides) of the blade 12. A variation in the blade load across the blade can result in a variation in the thickness of the release agent 11 across the surface 14 leading to oil defects, or inadequate cleaning of debris across the entire surface. As described above, a rigid member, such as the blade holder 20, can help to evenly distribute application forces along the blade. It may also be desirable to use a separately operable blade positioning mechanism at each end of the blade to achieve the desired blade load across the blade for preventing defects.

Figure 7:
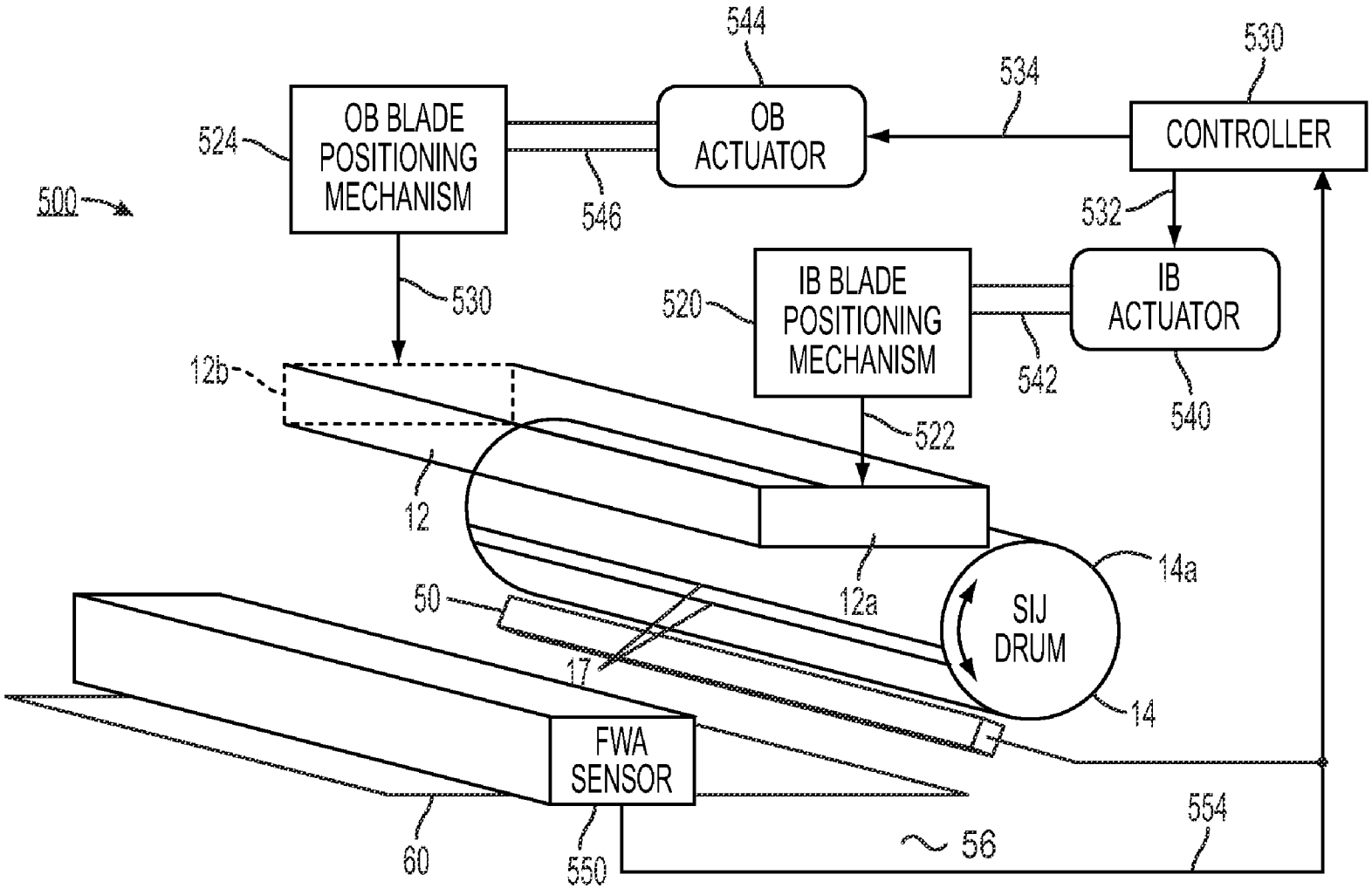
FIG. 7 is a diagram illustrating another embodiment of an apparatus for determining and maintaining the minimum blade load on image forming machine moving surfaces for preventing streak defects in images.

Referring now to FIG. 7, another example of a control system for determining and maintaining the minimum blade load for preventing defects is shown generally at 500. In this example, the blade positioning mechanism includes separately operable mechanisms disposed at opposite ends of the blade. An inboard blade positioning mechanism 520 is used to move the inboard end of the blade 12*a* directions towards and away from the surface 14. An inboard actuator 540 is connected to the inboard blade positioning mechanism 520 at 542 for providing bi-directional actuation to the inboard blade positioning mechanism 520 across a range of actuation. A controller 530 is connected to the inboard actuator at 532 for applying control signals to the actuator for actuating the inboard blade positioning mechanism 520 to increase and to decrease the blade load on the surface at the inboard end of the blade tip 13.

An outboard blade positioning mechanism 524 is used to move the outboard end of the blade 12*b* towards and away from surface 14 for varying the blade load applied at the blade tip 13. An outboard actuator 544 is connected to the outboard blade positioning mechanism 524 at 546 for providing actuation to the outboard blade positioning mechanism. The controller 530 is connected to the outboard actuator at 544 for applying control signals to the actuator for actuating the outboard blade positioning mechanism 524 to increase and to decrease the blade load on the surface 14 at the outboard end of the blade tip 13.

As described above, the actuators 540, 544 can provide the actuating movement to the blade positioning mechanisms 520, 524 in small increments across a range of actuation. The controller 530 can increment each actuator 540, 544 in either direction independently to adjust the blade load at the corresponding end of the blade 12*a*, 12*b* separately, as described in further detail below. The actuation positions of the actuators 540, 544 can be communicated to the controller 530 and used as representations of the magnitudes of the blade loads at each corresponding blade end 12*a*, 12*b*. The rigid blade holder 19 distributes the blade load across the blade tip in a linear manner.

Figure 8:
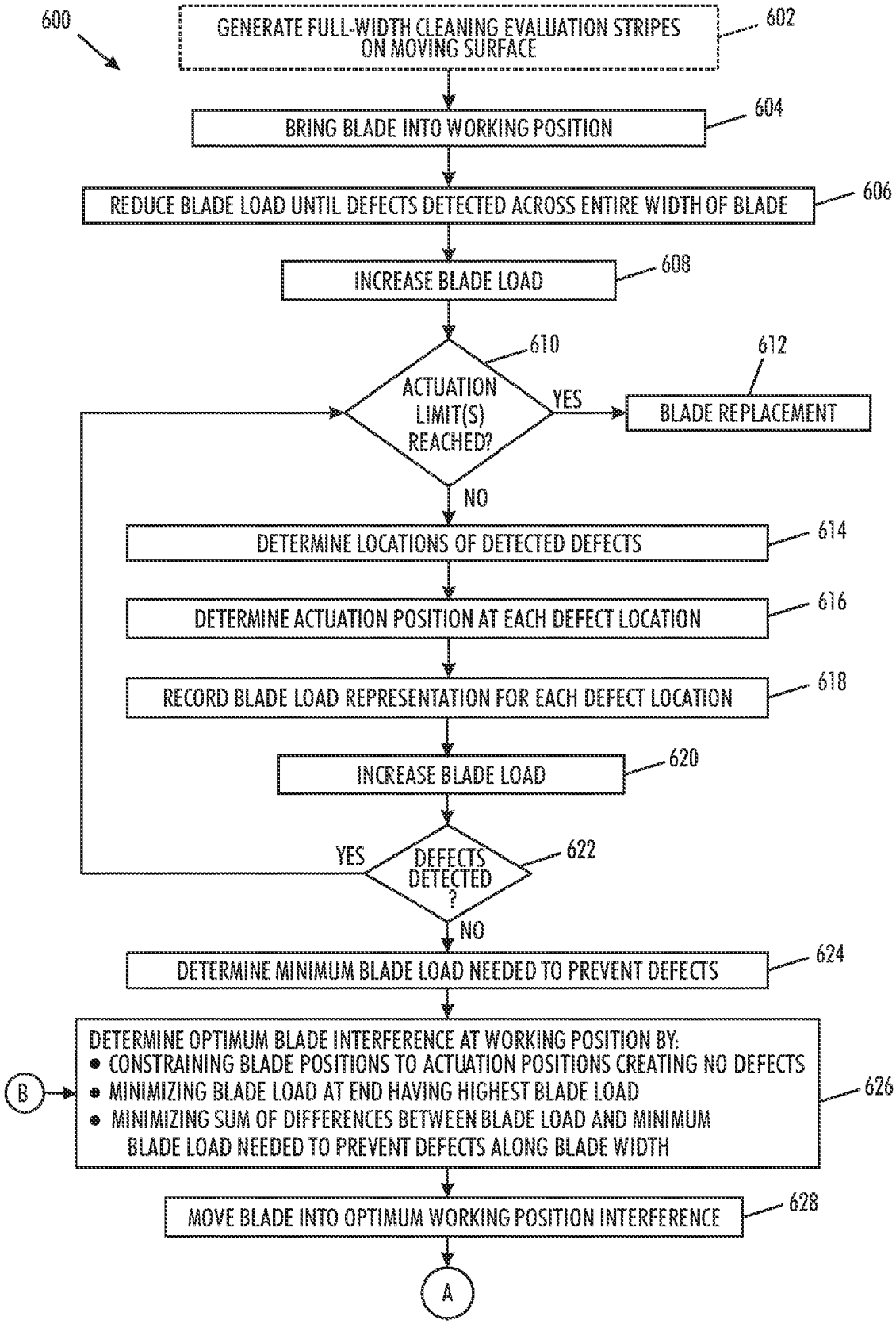
FIGS. 8 and 9 illustrate another embodiment of a method for determining and maintaining the minimum blade load on image forming machine moving surfaces for preventing streak defects in images.

Referring now to FIG. 8, a method of adjusting the blade load on the surface 14 using a pair of separately actuated bade positioning mechanisms 520, 524 is shown generally at 600. As described below, the method 600 can include determining the minimum blade load at the working position needed to prevent defects. The method 600 can also include determining and generating the optimum blade interference at the working position for creating this minimum blade load using the separately actuated blade mechanisms 520, 524. These parameters can be applicable to blades 12 used in cleaning operations, metering operations or both.

Cleaning evaluation stripes 17 can be generated on surface 14 at 602 for use in optimizing the blade load for a cleaning operation, as indicated by the dashed lines at 602. The evaluation stripes 17 extend across the surface 14 to be cleaned for the full width of the blade 12. In one example, the evaluation stripes 17 can be generated by developing stripes of toner on a photoreceptor surface 14*a* as shown in FIG. 7. In other examples, other materials suitable for removal by blade 12 during a cleaning operation can be deposited on the applicable surfaces 14*a*, 14*b*, 14*c*.

The blade 12 is brought into the working position at 604. Controller 530 can provide control signals to inboard and outboard actuators 540, 544 for actuating the inboard and outboard blade positioning mechanisms 520, 524 to move the blade into $WP_{DB}$, $WP_{WB}$ in a manner as described above.

The blade load is then reduced at 606 until defects are detected extending across the surface 14 for the full blade width, or until defects are detected extending across the full width of the print 60. The blade load can be reduced at each blade end 12*a*, 12*b* independently by controller 530 signaling actuators 540, 544 to actuate the blade positioning mechanisms 520, 524 to move the blade 12 in a direction away from the surface 14 while the blade remains in the working position $WP_{DB}$, $WP_{WB}$. The controller 530 reduces the blade load in small increments until the defects are detected. In a metering operation, the defects can be oil streaks, etc. extending across the entire print 60. In a cleaning operation, the defects can be evaluation stripes 17, or portions thereof, which are not removed by blade 12 so as to extend for the full blade width across surface 14.

The blade load is then increased at 608 by controller 530 signaling actuators 540, 544 to actuate the blade positioning mechanisms 520, 524 to move the blade 12 in a direction towards from the surface 14 with the blade 12 in the working position $WP_{DB}$, $WP_{WB}$. The blade load on the surface 14 is increased by incrementing each actuator 540, 544 in the manner as described above. If one or both actuators 540, 544 have reached their actuation limit as determined at 610, the controller determines that blade replacement is needed at 612. Information regarding the need for blade replacement can be provided, such as for example using a User Interface. The controller 530 can move a new blade into the working position by actuating the blade positioning mechanism.

If the actuation limit(s) were not reached, as determined at 610, the cross-process locations of the detected defects along the blade width are determined at 614. The actuation position at each defect location is determined at 616. If the actuation positions of the two actuators 540 and 544 are the same, this actuation position is used for the defect locations. If the actuation positions of the two actuators 540 and 544 are different, the actuation position at each defect location can be determined using linear interpolation of the two different actuation positions for each defect location along the blade width.

The actuation position at each defect location can be used as a representation (or indirect indication) of the blade load on the surface 14 for the defect location along the blade width and saved in correspondence with each location at 618.

The controller 530 then increases the blade load at 620 by signaling the actuators 540, 544 to actuate the blade positioning mechanisms 520, 524 to move the blade 12 in a direction towards the surface 14. If defects are detected again at 622, steps 610-620 are repeated until no more defects are detected.

When no further defects are detected at 622, the minimum blade load needed to prevent defects across the entire width of the blade 12 is determined at 624 using the highest blade load (or actuation position representing the blade load) stored at 618 for each location along the blade width that a defect was determined at 614.

Next, the optimum blade interference at the working position for obtaining maximum blade life is determined at 626 by meeting 3 criteria simultaneously. First, the blade positions are constrained to actuation positions which create no defects. Blade positions having blade interference which create defects are not considered optimum. Secondly, the blade load at the blade end having the highest blade load, as indicated by the highest actuation position for the corresponding actuator, is minimized. Thirdly, the sum of the differences between blade load applied and the minimum blade load needed to prevent defects (determined at 624) are minimized along the blade width. The optimum blade interference as created by the movement of the blade by the blade positioning mechanisms 520, 524 as actuated by the corresponding actuators 540, 544 is then determined by meeting each of these three criteria. The results of this optimum blade interference determination is an actuation position for each actuator 540, 544. The blade 12 is then moved into the optimum interference with surface 14 at 628 using the actuation positions determined at 626.

Figure 9:
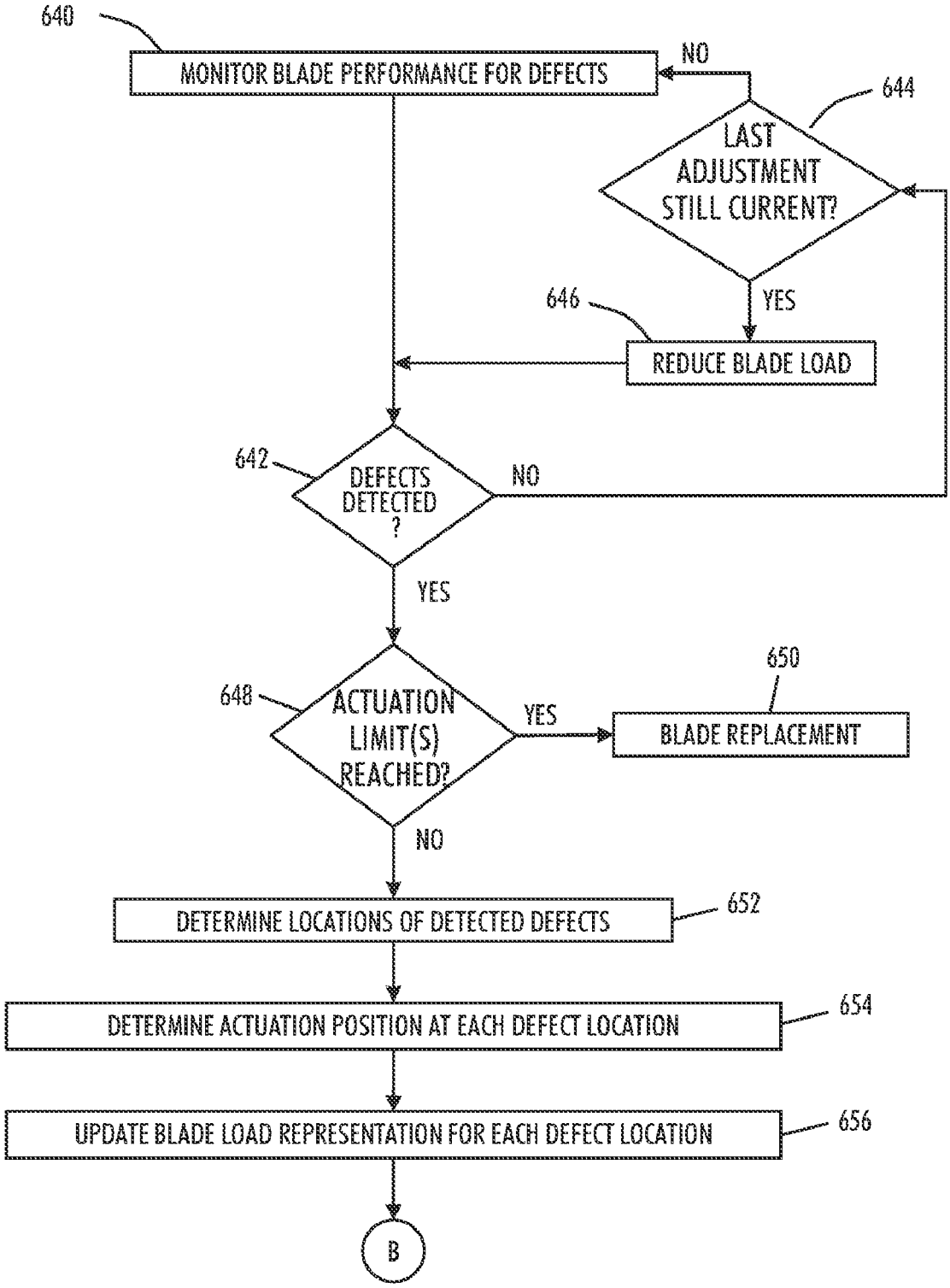

Referring now to FIG. 9, the blade performance can be monitored over time at 640 until defects are determined at 642. If no defects are detected at 642, the controller 530 determines if the last blade adjustment is still current using a threshold at 644. The threshold can be a predetermined number of prints being printed since the last blade adjustment was made, or it can be a time period. If last blade adjustment is determined to be no longer current at 644, the blade load can be reduced at 646 until defects are detected at 642. If the last blade adjustment is current, the blade performance monitoring is continued at 640.

Upon detecting defects at 642, it is determined if the actuation limit of one or both actuators 540, 544 has been reached at 648. If YES, blade replacement is signaled at 650.

If actuation range is still available at 648, the locations of the defects along the blade width are determined at 652 and the actuation position at each defect location is determined at 654 as described above.

The blade load corresponding to the location of the defect, or defects, is recorded at 656 and the optimum blade interference is determined again at 626 as described above. The blade is moved into the optimum working position interference with surface 14 at 628 using the actuation positions determined at 626, and steps 640-656 are repeated again for monitoring the blade performance.

In this manner, the blade interference with surface 14 is adjusted to provide the minimum blade load for good release agent metering and/or complete surface cleaning. The adjustment procedure can be performed between print jobs, that is, during non-production operational periods. These can include a specific test print evaluation cycle. Alternatively, the adjustment procedure can be performed during production of prints, such as during a large print job, if so desired. However since the adjustment procedure produces defects on output prints, the print job is suspended during the adjustment procedure. It can be done using non-production output prints interspersed between production prints, if so desired.

The blade load adjustment 600 can be performed at any time throughout the operational life of the blade 12. The sensor 50, 550 can be used to continually sense for defects on output prints 60 or on surface 14 and the adjustment procedure can be performed at any time when defects are detected. The adjustment procedure is capable of adjusting blade interference over time to compensate for blade set that otherwise would result in a loss of blade load due to blade material relaxation under prolonged strain. Similarly, changes in blade material modulus due to environmental changes in humidity and temperature can be compensated for by changing interference. Blade material responses to relaxation or environmental conditions do not need to be characterized since defect failures are monitored and controlled. Controlling defect failures removes relaxation and environmental considerations as constraints on blade material selection.

The adjustment procedure can also be performed when defects have not been detected. Stress conditions which result in the creation of defects may be temporary. If blade interference is increased to increase blade load during a temporary high stress condition that is causing defect(s), and the condition/cause ends, the blade load will be higher than required resulting in increased blade wear and a reduction of blade life. Performing the adjustment procedure on a periodic basis can readjust the blade load to the minimum blade load needed for preventing defects and extend blade life.

The blade load adjustment procedures described above can also be implemented to evaluate the impact of blade parameters on blade load latitude. Changes in blade material, release agent properties, SIJ drum design and process speed can be evaluated, such as in a lab setting. Furthermore, running changes to release agents or to the SIJ drum 14*a* or other moving surfaces in a launched product can be compensated for automatically by the control system using the adjustment procedures described above without requiring changes to the blade hardware. This can also reduce verification testing time. These advantages also apply to follow-on product design where process speed changes as well as release agent and SIJ drum changes may be desired.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An image forming machine comprising:

a moving surface;

a blade having a blade tip;

a blade positioning mechanism connected to the blade moving the blade into a working position wherein the blade tip engages the moving surface creating a blade load on the moving surface;

an actuator connected to the blade positioning mechanism;

a sensor detecting defects caused by insufficient blade load at the surface and producing a defect signal indicating a defect is being detected; and a controller connected to the sensor for receiving the defect signal and signaling the actuator to actuate the blade positioning mechanism for moving the blade within the working position to create the minimum blade load for preventing defects including:

reducing the blade load applied to the image forming machine moving surface until a defect is detected, incrementally increasing the blade load applied to the image forming machine moving surface, sensing for defects, and repeating the incrementally increasing and sensing until a defect is not detected.

2. The image forming machine of claim 1 wherein the moving surface is a drum rotating in an operational direction and the blade tip extends transversely across the drum metering release agent onto the drum during a metering operation.

3. The image forming machine of claim 1 wherein the moving surface is flat moving an operational direction and the blade tip extends transversely across the flat moving surface metering release agent onto the flat moving surface during a metering operation.

4. The image forming machine of claim 1 wherein the moving surface is a belt moving an operational direction and the blade tip extends transversely across the belt metering release agent onto the surface during a metering operation.

5. The image forming machine of claim 1 wherein the moving surface is a drum rotating in an operational direction and the blade tip extends transversely across the drum removing debris from the drum during a cleaning operation.

6. The image forming machine of claim 1 wherein the moving surface is flat moving an operational direction and the blade tip extends transversely across the flat moving surface removing debris from the drum during a cleaning operation.

7. The image forming machine of claim 1 wherein the moving surface is a belt moving an operational direction and the blade tip extends transversely across the belt removing debris from the drum during a cleaning operation.

8. The image forming machine of claim 1 wherein the sensor is disposed adjacent the moving surface for detecting defects on the moving surface.

9. The image forming machine of claim 1 wherein the sensor is disposed adjacent output prints for detecting defects on the output prints.

10. The image forming machine of claim 1 further comprising:

a plurality of blades each having a blade tip, wherein the blade positioning mechanism is connected to the plurality of blades moving the plurality of blades into a working position one at a time.

11. The image forming machine of claim 1 further comprising:

the blade positioning mechanism being connected to an end of the blade.

12. The image forming machine of claim 1 further comprising:

the blade positioning mechanism being connected to opposite ends of the blade.

13. The image forming machine of claim 12 wherein the blade positioning mechanism includes two separately actuated blade positioning mechanisms each connected to an end of the blade and the actuator includes two actuators each connected to a different blade positioning mechanism for independent control by the controller.

14. A blade engagement apparatus for an associated image forming machine having an associated moving surface, the apparatus comprising:

a blade having a blade tip;

a blade positioning mechanism connected to the blade moving the blade into a working position wherein the blade tip engages the associated moving surface creating a blade load on the associated moving surface;

an actuator connected to the blade positioning mechanism;

a sensor detecting defects caused by insufficient blade load at the associated moving surface and producing a defect signal indicating a defect is being detected; and a controller connected to the sensor receiving the defect signal and signaling the actuator to actuate the blade positioning mechanism moving the blade at the working position to create the minimum blade load for preventing defects including:

reducing the blade load applied to the image forming machine moving surface until a defect is detected, incrementally increasing the blade load applied to the image forming machine moving surface, sensing for defects, and repeating the incrementally increasing and sensing until a defect is not detected.

15. The blade engagement apparatus of claim 14 wherein the blade engagement apparatus is a release agent metering apparatus metering release agent onto the associated image forming machine moving surface with the blade disposed in the working position.

16. The blade engagement apparatus of claim 14 wherein the blade engagement apparatus is a cleaning apparatus cleaning debris from the associated image forming machine moving surface with the blade disposed in the working position.

17. The blade engagement apparatus of claim 14 further comprising two separately actuated blade positioning mechanisms each connected to an end of the blade and two actuators each connected to a different blade positioning mechanism for independent control by the controller.

18. A method of determining the minimum blade load applied by a blade engagement apparatus blade to an image forming machine moving surface for preventing image defects comprising:

reducing the blade load applied to the image forming machine moving surface until a defect is detected;

incrementally increasing the blade load applied to the image forming machine moving surface;

sensing for defects; and repeating the incrementally increasing and sensing until a defect is not detected.

19. The method of claim 18 further comprising:

reducing the blade load applied to the image forming machine moving surface until defects are detected across the entire width of the blade;

increasing the blade load applied to the image forming machine moving surface;

determining locations of the detected defects;

determining actuation positions of two actuators for each defect location, wherein each actuator moves an opposite end of the blade;

recording the actuation positions as blade load representations for each defect location;

repeating the increasing the blade load, the determining locations, the determining actuation positions and the recording the actuation positions until a defect is not detected.

20. The method of claim 18 further comprising:

determining the optimum blade interference by constraining blade positions to actuation positions creating no defects, minimizing the blade load at the blade end having the highest blade load, and minimizing the sum of differences between blade load and minimum blade load needed to prevent defects along the blade width.

* * * * *